US010990047B2

(12) United States Patent
Lee

(10) Patent No.: US 10,990,047 B2
(45) Date of Patent: Apr. 27, 2021

(54) HEATER FOR FUSER HAVING HEATING ELEMENTS

(71) Applicant: HEWLETT-PACKARD DEVELOPMENT COMPANY, L.P., Spring, TX (US)

(72) Inventor: Sunhyung Lee, Yongin-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/955,198

(22) PCT Filed: Jul. 26, 2018

(86) PCT No.: PCT/KR2018/008448

§ 371 (c)(1),
(2) Date: Jun. 18, 2020

(87) PCT Pub. No.: WO2019/124664

PCT Pub. Date: Jun. 27, 2019

(65) Prior Publication Data

US 2020/0333736 A1 Oct. 22, 2020

(30) Foreign Application Priority Data

Dec. 18, 2017 (KR) ..... 10-2017-0174174

(51) Int. Cl.
*G03G 15/20* (2006.01)

(52) U.S. Cl.
CPC ..... *G03G 15/2053* (2013.01)

(58) Field of Classification Search
CPC ..... G03G 15/2042; G03G 15/2053; G03G 15/2064; G03G 2215/2016
See application file for complete search history.

(56) References Cited

U.S. PATENT DOCUMENTS

2012/0269535 A1* 10/2012 Mine ..... G03G 15/2042 399/90
2013/0026154 A1* 1/2013 Taniguchi ..... G03G 15/2053 219/385

(Continued)

FOREIGN PATENT DOCUMENTS

JP 2000077170 3/2000
JP 2014106279 6/2014

(Continued)

*Primary Examiner* — Sophia S Chen
(74) *Attorney, Agent, or Firm* — Staas & Halsey LLP

(57) ABSTRACT

A heater for a fuser includes a substrate, a first pair of heating elements provided on the substrate, and a second pair of heating elements provided on the substrate. The first pair of heating elements and the second pair of heating elements extend in a length direction of the substrate. The second pair of heating elements is provided between one heating element among the first pair of heating elements and the other heating element among the first pair of heating elements. A distance between the heating elements of the second pair of heating elements is greater than or equal to a value obtained by adding widths of each of the first pair of heating elements and the second pair of heating elements at a center in the length direction of each of the heating elements from the first and second pairs of heating elements.

16 Claims, 10 Drawing Sheets

(56) References Cited

U.S. PATENT DOCUMENTS

| | | | | |
|---|---|---|---|---|
| 2014/0169845 | A1* | 6/2014 | Nakahara | G03G 15/2053 399/328 |
| 2014/0255065 | A1* | 9/2014 | Takahashi | G03G 15/2064 399/329 |
| 2015/0227094 | A1 | 8/2015 | Yabuki | |
| 2016/0234882 | A1* | 8/2016 | Takagi | G03G 15/2053 |
| 2016/0238974 | A1* | 8/2016 | Kadowaki | G03G 15/2042 |
| 2018/0335731 | A1* | 11/2018 | Ogura | G03G 15/2053 |

FOREIGN PATENT DOCUMENTS

| | | |
|---|---|---|
| JP | 5804876 | 11/2015 |
| JP | 2015206943 | 11/2015 |
| JP | 5893261 | 3/2016 |
| JP | 2016139487 | 8/2016 |
| JP | 2017-58415 | 3/2017 |
| JP | 2017059327 | 3/2017 |
| JP | 2017-111337 | 6/2017 |
| JP | 6149638 | 6/2017 |
| KR | 10-2013-0027976 | 3/2013 |
| KR | 10-2015-0136022 | 12/2015 |
| KR | 20160030374 | 3/2016 |

* cited by examiner

[Fig. 1]
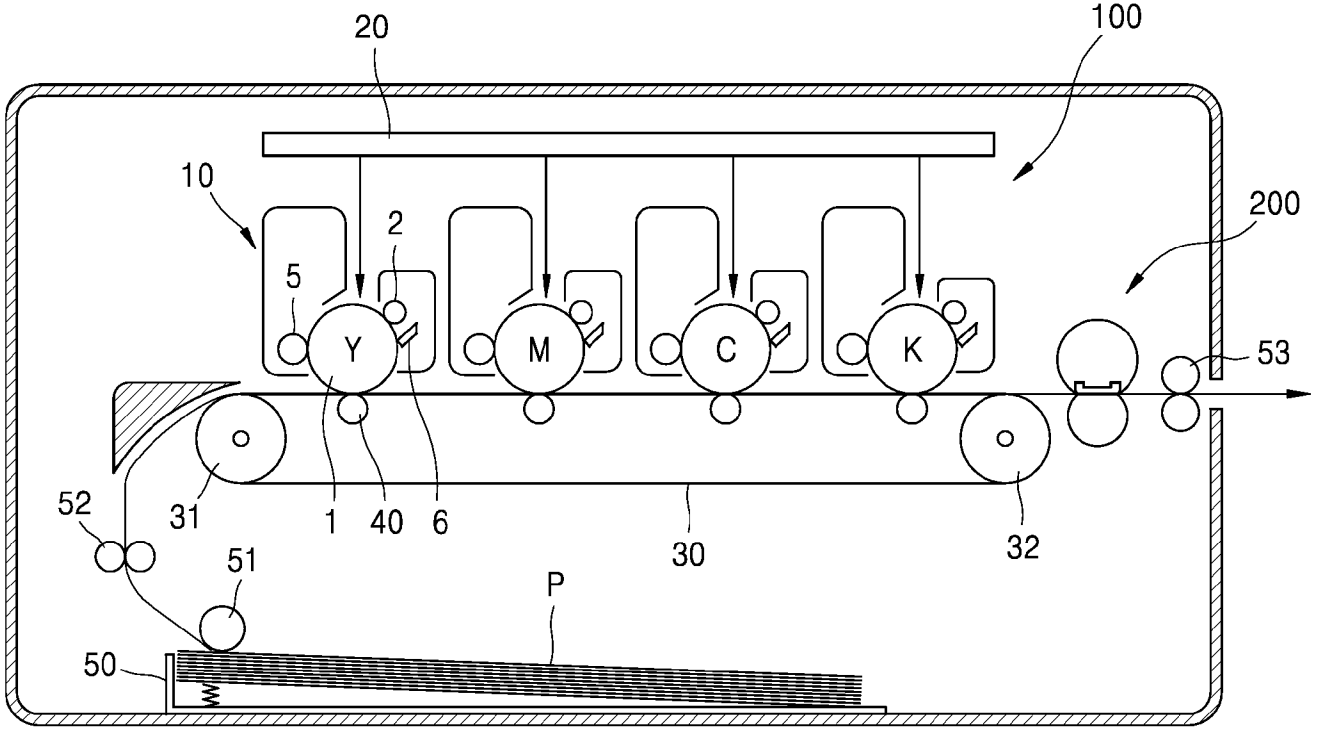

[Fig. 2]
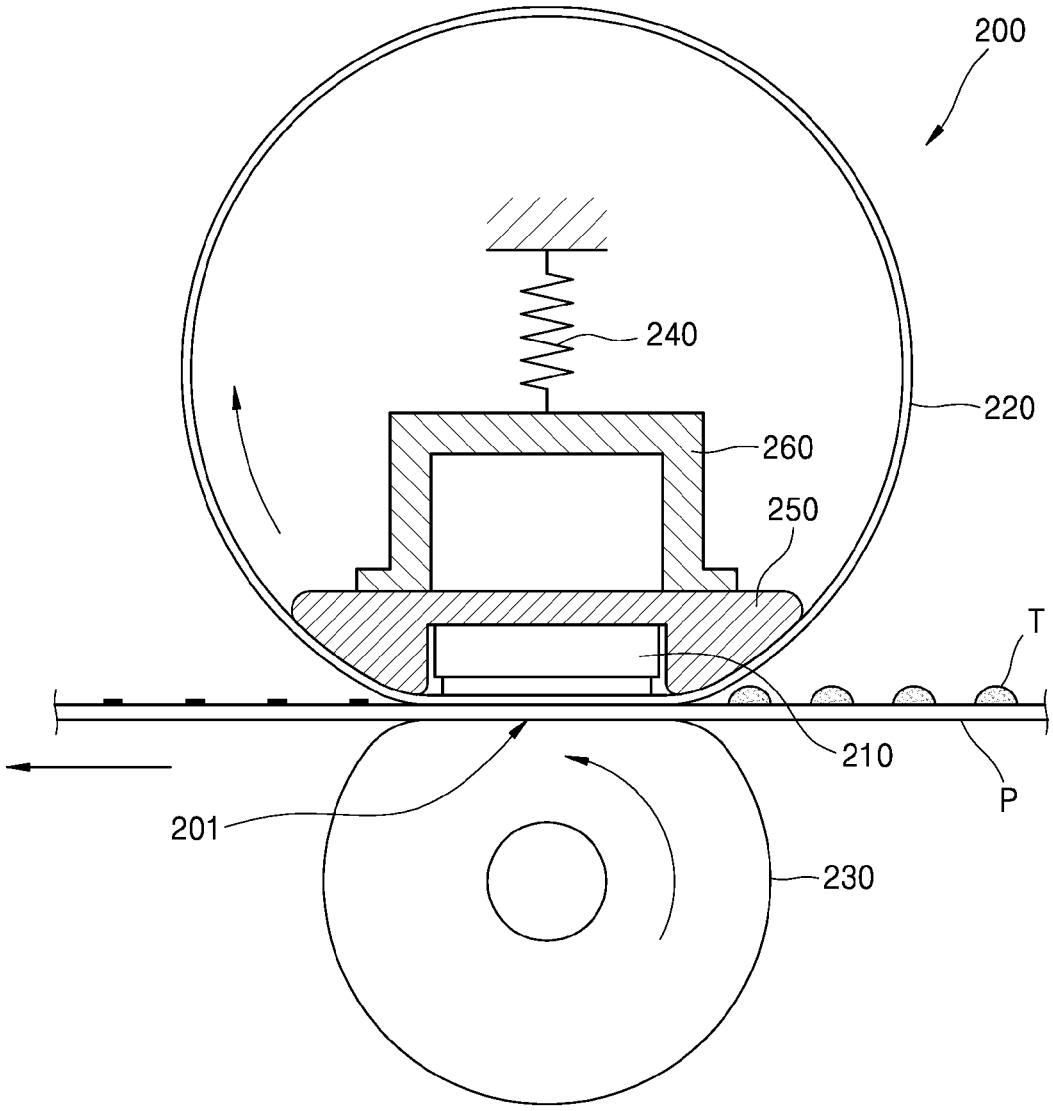
[Fig. 3]
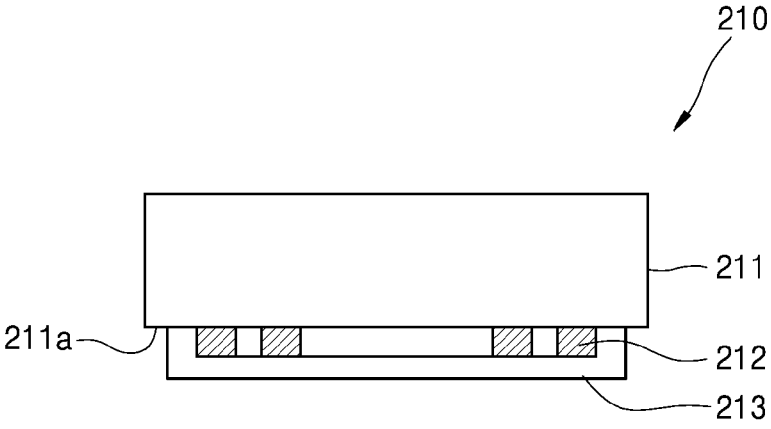

[Fig. 4]
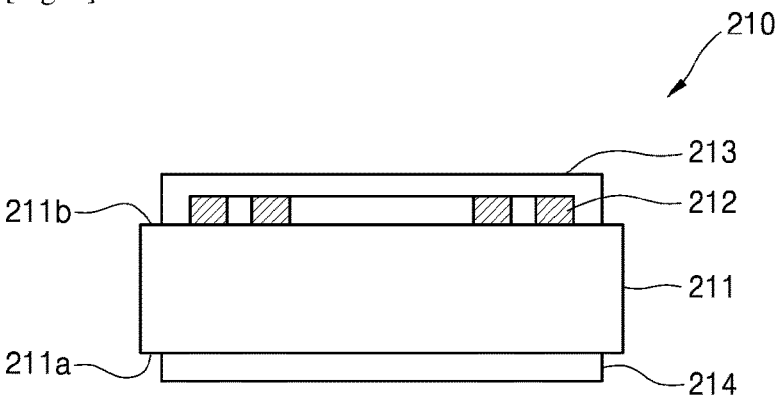
[Fig. 5]
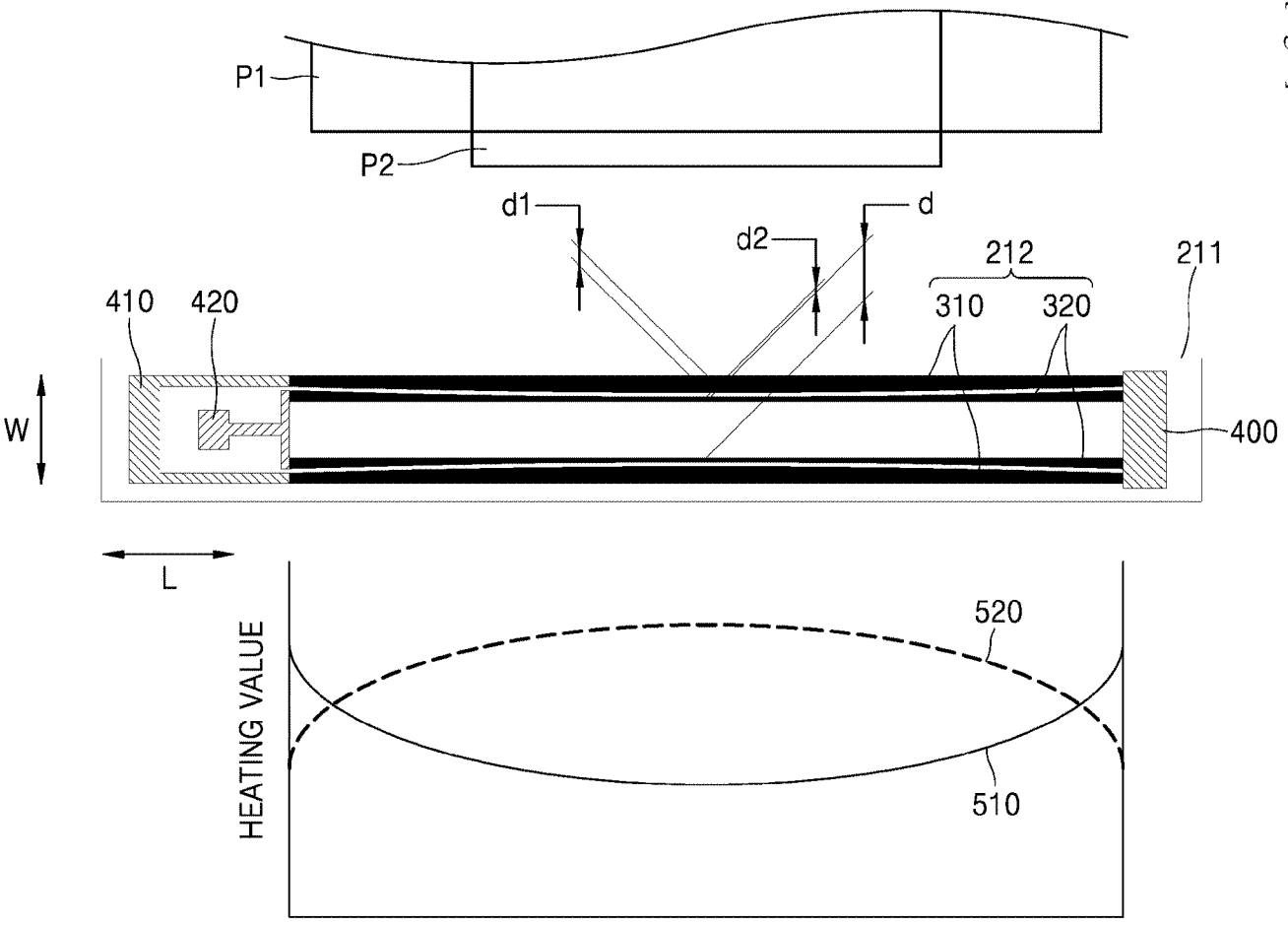

[Fig. 6]
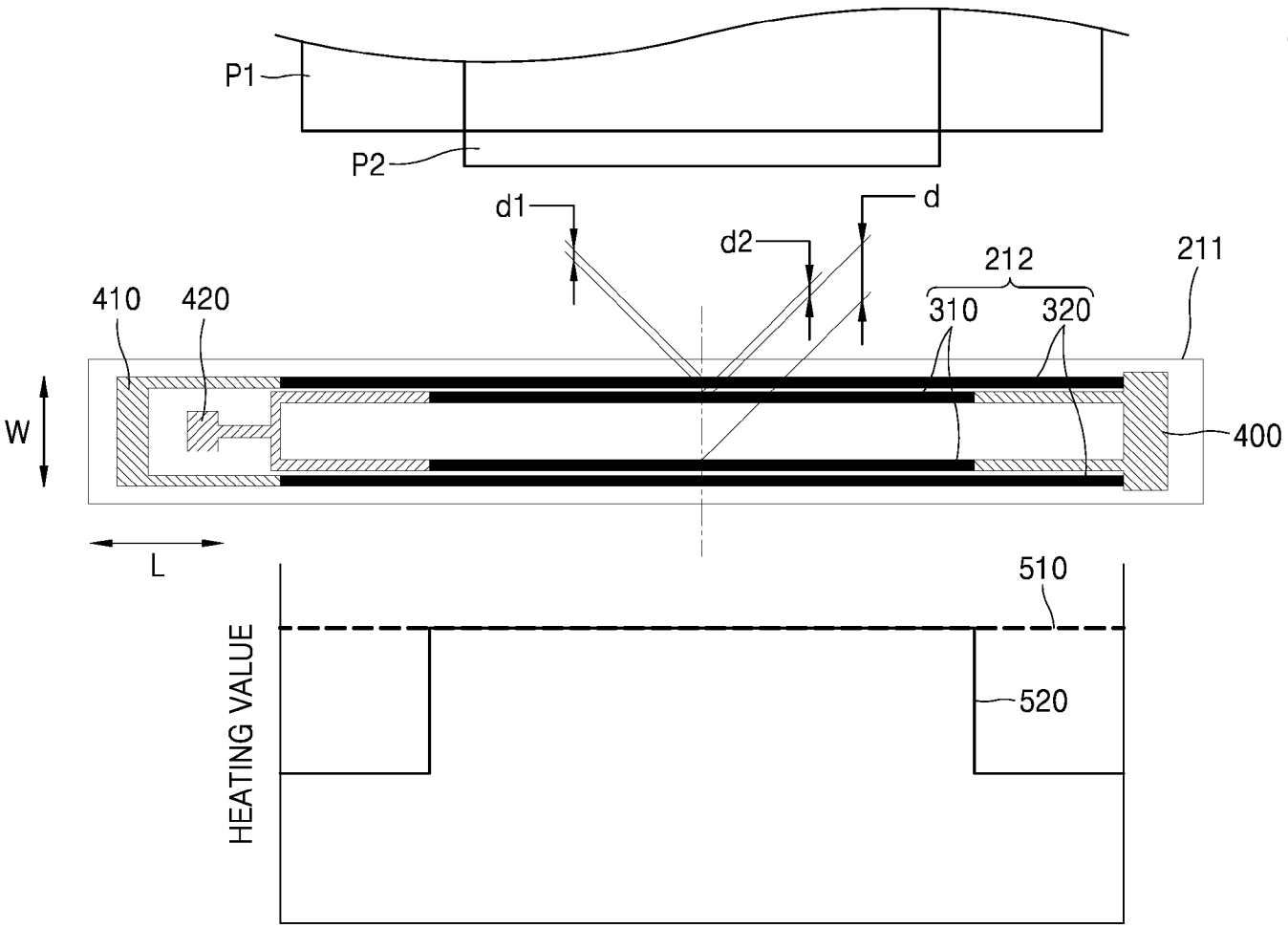

[Fig. 7]
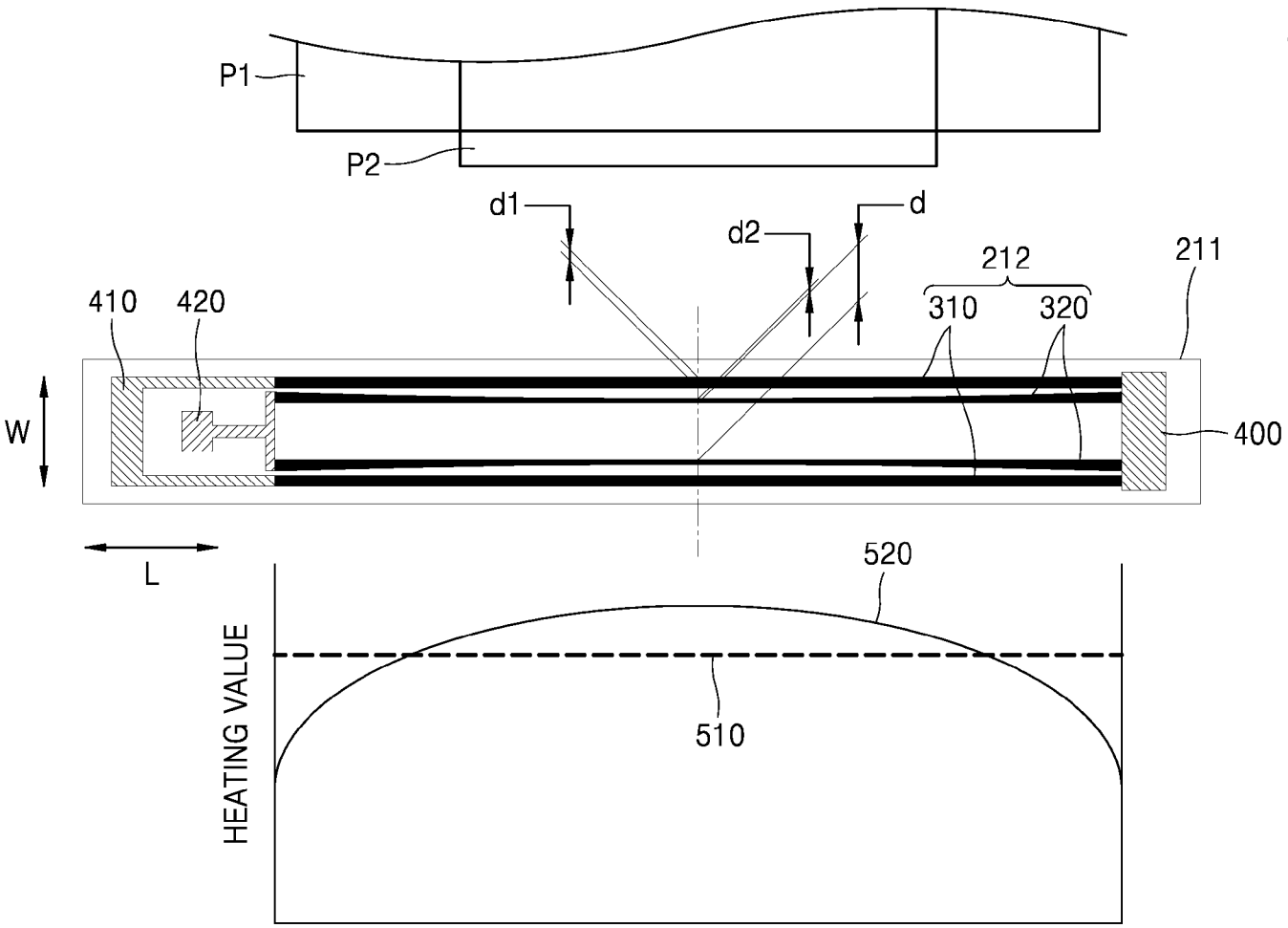

[Fig. 8]
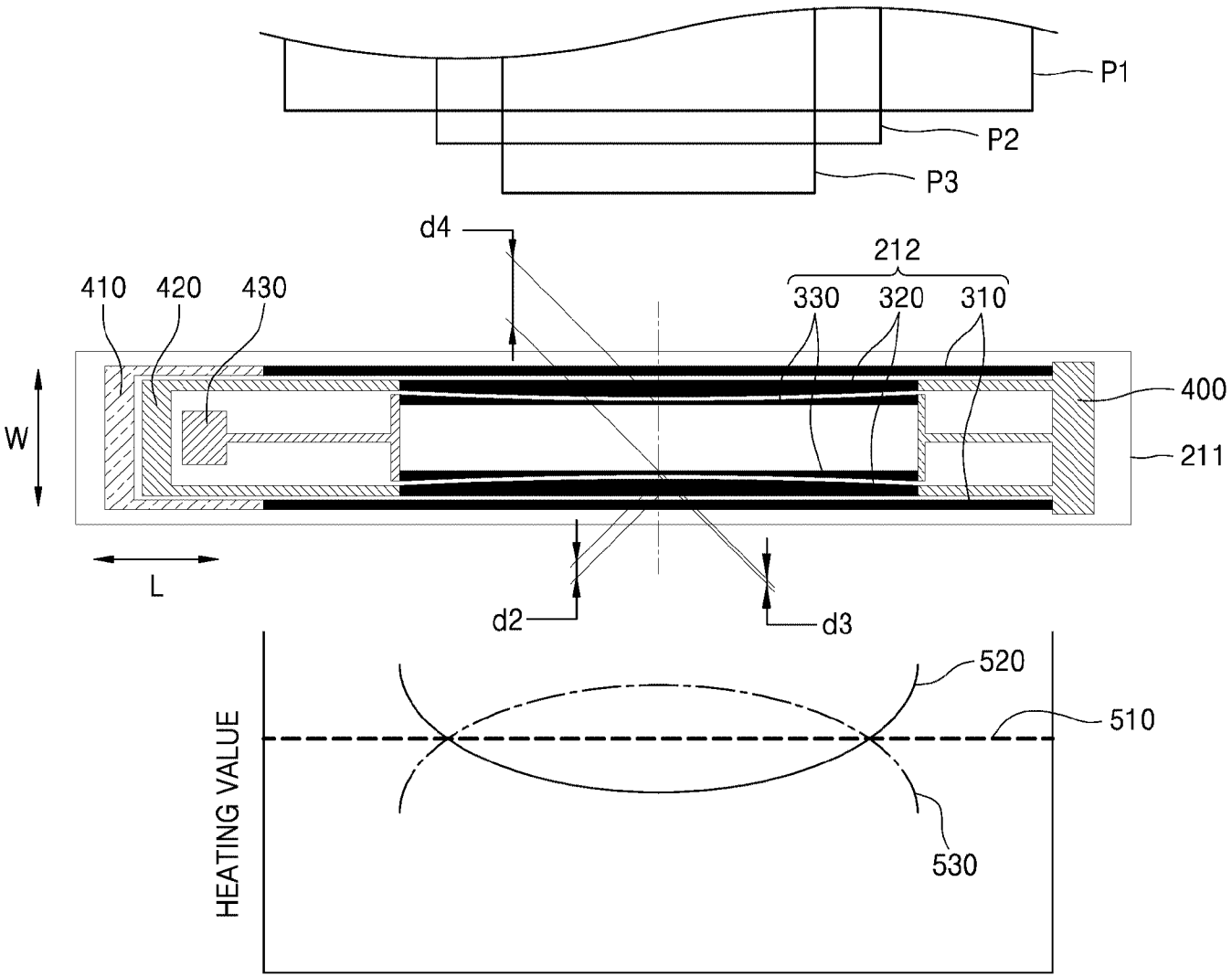

[Fig. 9]
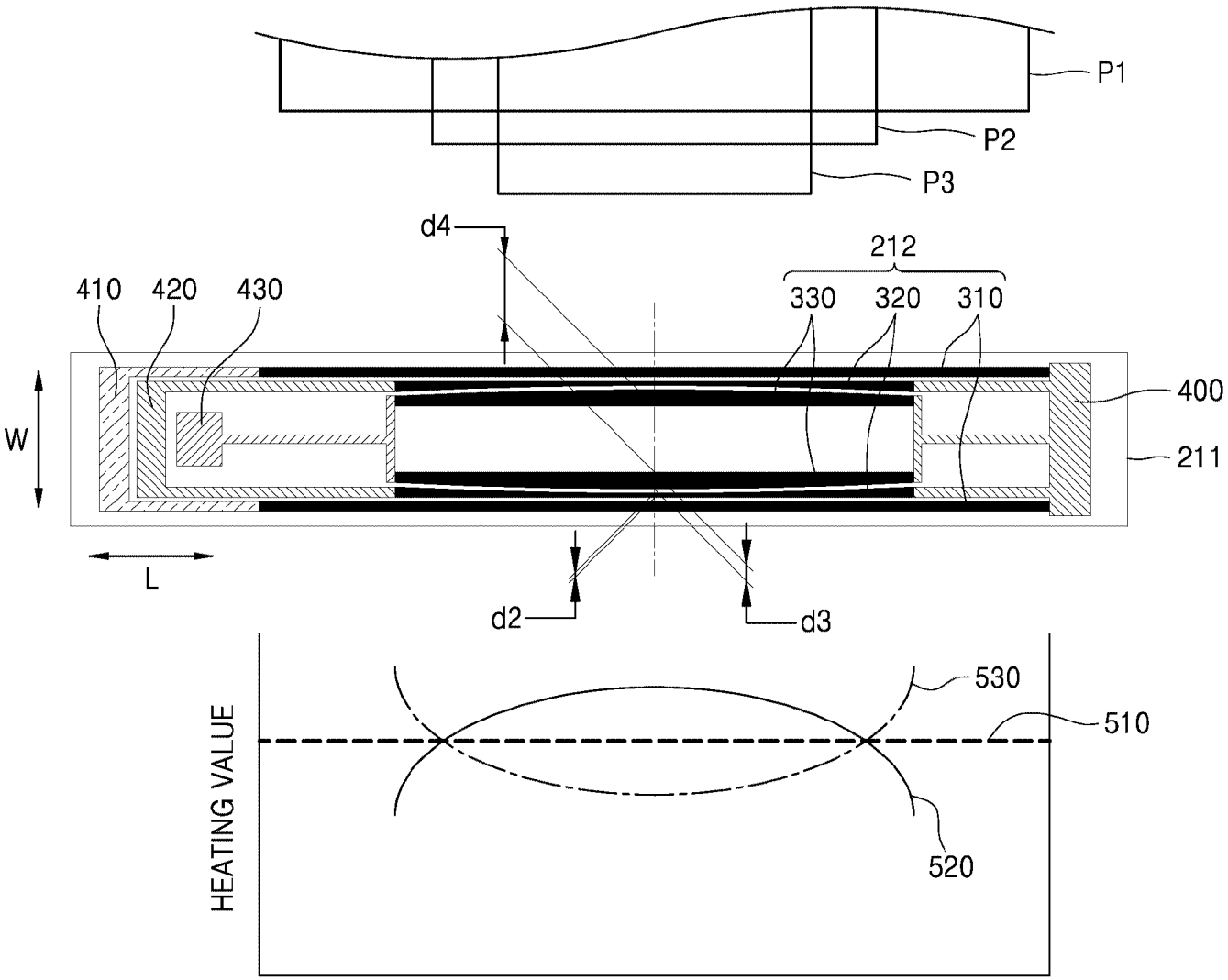

[Fig. 10]
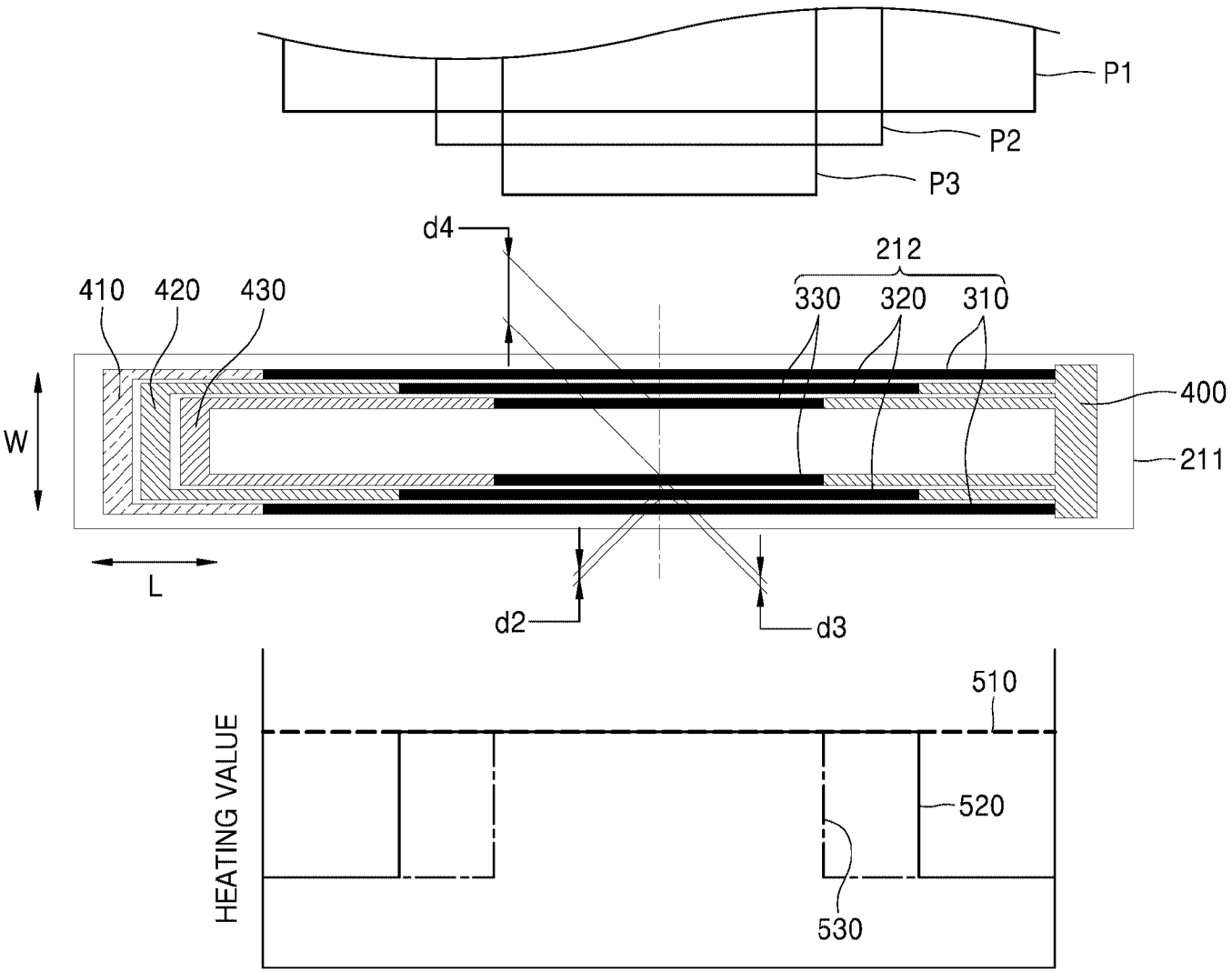

[Fig. 11A]
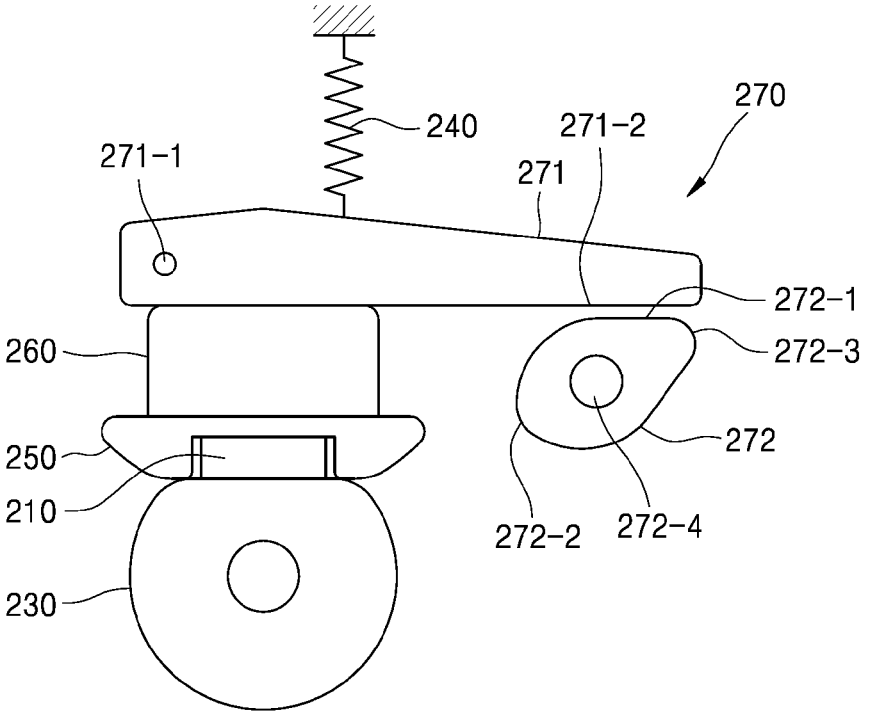
[Fig. 11B]
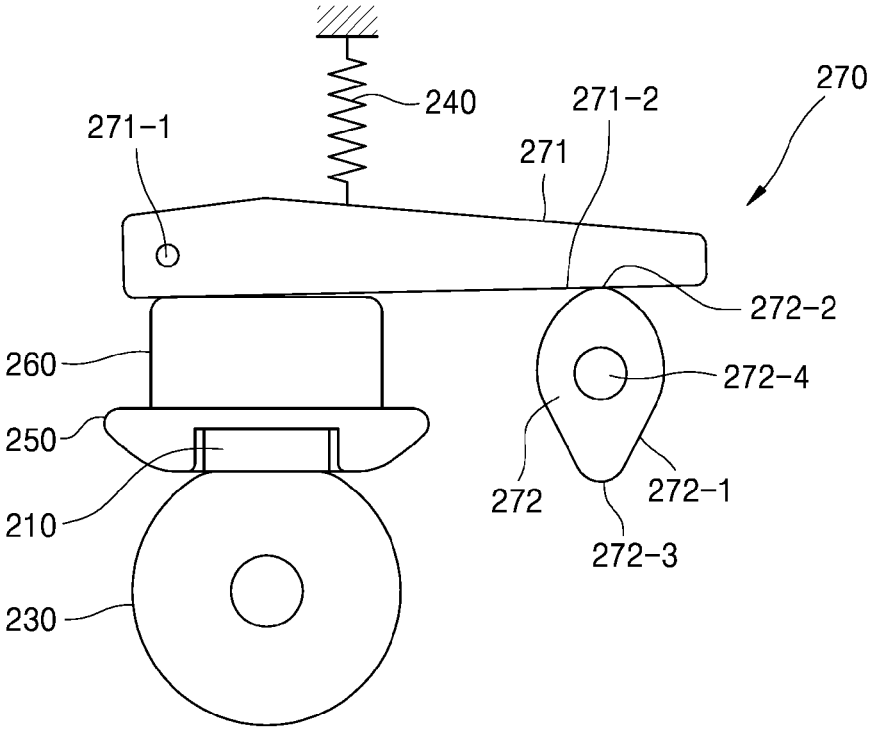

[Fig. 11C]
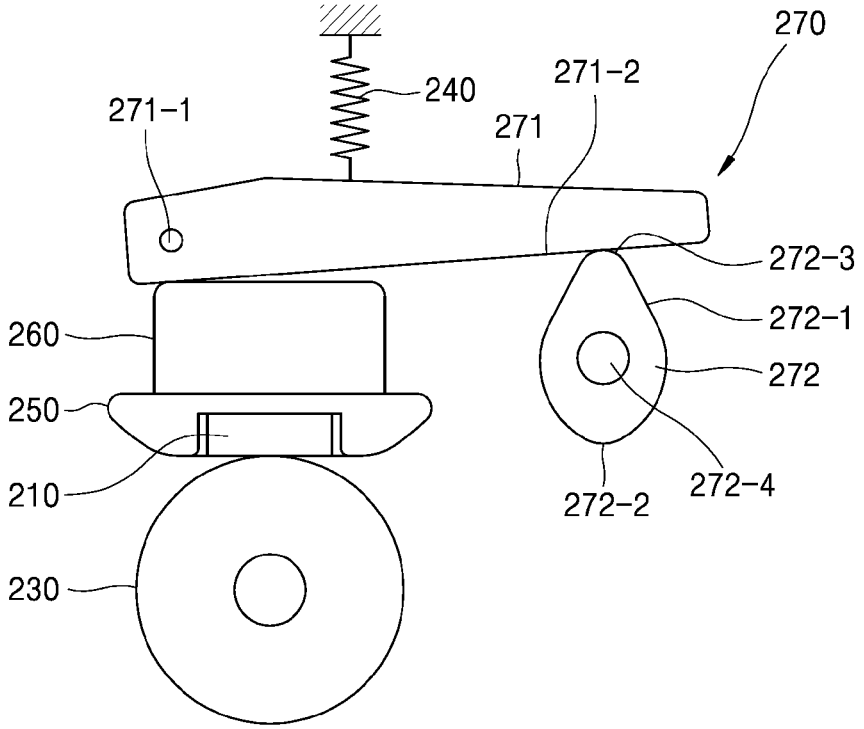

HEATER FOR FUSER HAVING HEATING ELEMENTS

CROSS REFERENCE TO RELATED APPLICATIONS

This application is filed under 35 U.S.C. 0.371 as a National Stage of PCT International Application No. PCT/KR2018/008448, filed on Jul. 26, 2018, in the Korean Intellectual Property Office, which claims the priority benefit of Korean Patent Application No. 10-2017-0174174, filed on Dec. 18, 2017, in the Korean Intellectual Property Office. The disclosure of PCT International Application No. PCT/KR2018/008448, filed on Jul. 26, 2018, in the Korean Intellectual Property Office, is incorporated by reference herein in its entirety. The disclosure of Korean Patent Application No. 10-2017-0174174, filed on Dec. 18, 2017, in the Korean Intellectual Property Office, is incorporated by reference herein in its entirety.

BACKGROUND ART

In a printer using an electro-photographic method, a toner is supplied to an electrostatic latent image formed in an image receptor to form a visible toner image on the image receptor and, after the toner image is transferred to a recording medium, the transferred toner image is fused to the recording medium.

A fusing process accompanies a process of applying heat and pressure to the toner. The fuser includes a heating roller and a pressing roller that are engaged with each other and that form a fusing nip. The heating roller is heated by a heater such as a halogen lamp. The recording medium to which the toner image is transferred receives heat and pressure while passing the fusing nip, and the toner image is fused to the recording medium.

In response to demands for high speed printing and low energy fusing, a fusing belt with smaller heat capacity than the heating roller may be used. As a heater, a plate heater for locally heating the fusing belt in the fusing nip may be adopted.

BRIEF DESCRIPTION OF DRAWINGS

FIG. 1 is a schematic block diagram of an example of an electro-photographic printer;

FIG. 2 is a schematic block diagram of an example of a fuser;

FIG. 3 is a schematic side view of an example of a heater;

FIG. 4 is a schematic side view of an example of a heater;

FIG. 5 is a plan view of an example of a heater, which illustrates distribution of heating values;

FIG. 6 is a plan view of an example of a heater including two pairs of heating elements, which illustrates distribution of heating values;

FIG. 7 is a plan view of an example of a heater including two pairs of heating elements, which illustrates distribution of heating values;

FIG. 8 is a plan view of an example of a heater including three pairs of heating elements, which illustrates distribution of heating values;

FIG. 9 is a plan view of an example of a heater including three pairs of heating elements, which illustrates distribution of heating values;

FIG. 10 is a plan view of an example of a heater including three pairs of heating elements, which illustrates distribution of heating values; and FIGS. 11A to 11C are schematic block diagrams of an example of a fuser that adopts a pressing force variable member.

MODE FOR THE INVENTION

FIG. 1 is a schematic block diagram of an example of a printer to which a heater and a fuser according to the disclosure are applied. Referring to FIG. 1, the printer may include a printing unit 100 for forming visible toner images on a recording medium P, for example, paper and a fuser 200 for fusing the toner images to the recording medium P. The printing unit 100 according to the example forms color toner images on the recording medium P by an electro-photographic method.

The printing unit 100 may include a plurality of photosensitive drums 1, a plurality of developing devices 10, and a paper feed belt 30. The photosensitive drum 1, as an example of photoconductor on a surface of which an electrostatic latent image is formed, may include a conductive metal pipe and a photosensitive layer formed on an outer circumference of the conductive metal pipe. The plurality of developing devices 10 respectively correspond to the plurality of photosensitive drums 1. The plurality of developing devices 10 forms toner images on the surfaces of the plurality of photosensitive drums 1 by supplying toners to the electrostatic latent images formed on the plurality of photosensitive drums 1 and performing development. The plurality of developing devices 10 may be respectively replaced independent of the plurality of photosensitive drums 1. In addition, the plurality of developing devices 10 may be in the forms of cartridges including the photosensitive drums 1.

For color printing, the plurality of developing devices 10 may include a plurality of developing devices 10Y, 10M, 10C, and 10K that accommodate yellow Y, magenta M, cyan C, and black K toners, respectively. Other than the above-described colors, developing devices that accommodate toners of various colors such as light magenta and white may be further adopted. Hereinafter, the printer including the plurality of developing devices 10Y, 10M, 10C, and 10K will be described. Unless otherwise described, when Y, M, C, and K are added to reference numerals, the reference numerals denote components for printing an image by using the yellow Y, magenta M, cyan C, and black K toners.

The developing device 10 supplies the toner accommodated therein to the electrostatic latent image formed on the photosensitive drum 1 and develops the electrostatic latent image as the visible toner image. The developing device 10 may include developing roller 5. The developing roller 5 supplies the toner in the developing device 10 to the photosensitive drum 1. A developing bias voltage may be applied to the developing roller 5. A regulating member that is not shown regulates amounts of the toners supplied to a developing region in which the photosensitive drum 1 and the developing roller 5 face each other by the developing roller 5.

When a two-component developing method is adopted, magnetic carrier and the toner may be accommodated in the developing device 10. The developing roller 5 may be separate from the photosensitive drum 1 by tens or hundreds of microns. Although not shown in the drawing, the developing roller 5 may have a shape in which a magnetic roller is arranged in hollow cylindrical sleeve. The toner are attached to a surface of the magnetic carrier. The magnetic carrier is attached to a surface of the developing roller 5 and is carried to the developing region in which the photosensitive drum 1 and the developing roller 5 face each other. Due to the developing bias voltage applied between the developing roller 5 and the photosensitive drum 1, the toner is supplied to the photosensitive drum 1 and develops the electrostatic latent image formed on the surface of the photosensitive drum 1 as the visible toner image. The developing device 10 may include an agitator (not shown) for mixing the toner and the magnetic carrier with each other, agitating the mixture, and carrying the agitated mixture to the developing roller 5. The agitator may be, for example, an auger and a plurality of agitators may be provided in the developing device 10.

When a one-component developing method in which the magnetic carrier is not used is adopted, the developing roller 5 may rotate while contacting the photosensitive drum 1. The developing roller 5 may rotate while being separate from the photosensitive drum 1 by tens or hundreds of microns. The developing device 10 may further include supply roller (not shown) for attaching the toner to the surface of the developing roller 5. A supply bias voltage may be applied to the supply roller. The developing device 10 may further include an agitator (not shown). The agitator may agitate the toner so that the toner is triboelectrically charged. The agitator may be, for example, an auger.

Charging roller 2 is an example of a charging device for charging the photosensitive drum 1 so that the photosensitive drum 1 has a uniform surface electric potential. Instead of the charging roller 2, a charging brush or corona charging device may be adopted.

Cleaning blade 6 is an example of a cleaning member for removing the toner and alien substances that reside on the surface of the photosensitive drum 1 after a transferring process. Instead of the cleaning blade 6, a cleaning apparatus of another type such as a rotating brush may be adopted.

An example of a developing method of a printer as an example was described in detail. However, other various developing methods may be adopted by the printer.

An exposure device 20 irradiates lights modulated in accordance with image information onto the photosensitive drums 1Y, 1M, 1C, and 1K and forms the electrostatic latent images corresponding to yellow (Y), magenta (M), cyan (C), and black (K) images. As an example of the exposure device 20, a laser scanning unit (LSU) that uses a laser diode as a light source and a light emitting diode (LED) exposure device using an LED as a light source may be adopted.

The paper feed belt 30 supports and feeds the recording medium P. The paper feed belt 30, for example, may be supported by supporting rollers 31 and 32 and may be circulation driven. The recording medium P is picked up by a pickup roller 51 from a loading table 50 one by one, is fed by feed rollers 52, and may be attached to the paper feed belt 30 by, for example, electrostatic force. A plurality of transfer rollers 40 may be arranged in positions in which the plurality of transfer rollers 40 face the plurality of photosensitive drums 1Y, 1M, 1C, and 1K with the paper feed belt 30 interposed therebetween. The plurality of transfer rollers 40 are an example of transfer units for transferring the toner images from the plurality of photosensitive drums 1Y, 1M, 1C, and 1K to the recording medium P supported by the paper feed belt 30. The transfer bias voltage for transferring the toner images to the recording medium P is applied to the plurality of transfer rollers 40. Instead of the transfer rollers 40, corona transfer units or transfer units of a pin scorotron method may be adopted.

The fuser 200 applies heat and/or pressure to the image transferred to the recording medium P and may fuse the image to the recording medium P. The recording medium P that passes the fuser 200 is discharged by discharge roller 53.

By the above-described configuration, the exposure device 20 irradiates lights modulated in response to image information of the respective colors onto the plurality of photosensitive drums 1Y, 1M, 1C, and 1K and forms the electrostatic latent images. The plurality of developing devices 10Y, 10M, 10C, and 10K respectively supply the Y, M, C, and K colored toners to the electrostatic latent images formed on the plurality of photosensitive drums 1Y, 1M, 1C, and 1K and respectively form the Y, M, C, and K colored visible toner images on the surfaces of the plurality of photosensitive drums 1Y, 1M, 1C, and 1K. The recording medium P loaded on the loading table 50 is supplied to the paper feed belt 30 by the pickup roller 51 and the feed rollers 52 and is maintained on the paper feed belt 30, for example, by electrostatic force. The Y, M, C, and K colored toner images are sequentially transferred onto the recording medium P fed by the paper feed belt 30 by the transfer bias voltage applied to the plurality of transfer rollers 40. When the recording medium P passes the fuser 200, the toner images are fused to the recording medium P by heat and pressure. The recording medium P to which the toner images are completely fused is discharged by the discharge roller 53.

The printer illustrated in FIG. 1 adopts a method of directly transferring the toner images developed on the plurality of photosensitive drums 1Y, 1M, 1C, and 1K to the recording medium P supported by the paper feed belt 30. However, another transfer method is available. For example, a method of intermediate transferring the toner images developed on the plurality of photosensitive drums 1Y, 1M, 1C, and 1K to an intermediate transfer belt (not shown) and transferring the toner images to the recording medium P may be adopted.

When a single-colored image, for example, a black image is printed, the printer may include the developing device 10K among the plurality of developing devices 10Y, 10M, 10C, and 10K. The paper feed belt 30 may not be provided. The recording medium P is fed between the photosensitive drum 1K and the transfer roller 40 and the toner image formed on the photosensitive drum 1K may be transferred to the recording medium P by the transfer bias voltage applied to the transfer roller 40.

The fuser 200 applies heat and pressure to the toner image and fuses the toner image to the recording medium P. In order to increase a printing speed and to reduce energy consumption, a heated portion with small heat capacity may be adopted to the fuser 200. For example, a thin film-shaped endless belt may be adopted as the heated portion. Therefore, a temperature of the fuser 200 may be rapidly increased to a temperature at which the toner image may be fused and printing may be performed within a short time after the printer is turned on.

FIG. 2 is a schematic block diagram of an example of a fuser. Referring to FIG. 2, the fuser 200 may include a flexible endless belt 220, a heater 210, and a backup member 230. The heater 210 is positioned inside the flexible endless belt 220 and heats the flexible endless belt 220. The backup member 230 is positioned outside the flexible endless belt 220 to face the heater 210. A pressing member 240 may provide pressing force to at least one of the heater 210 and the backup member 230. The heater 210 and the backup member 230 are pressed to each other by the pressing force of the pressing member 240 so that a fusing nip 201 is formed. The heater 210 heats the flexible endless belt 220 in the fusing nip 201. When the recording medium P on a surface of which the toner images T are formed passes the fusing nip 201, the toner images T are fused to the recording medium P by heat and pressure. Although not shown in the drawing, the fuser 200 may further include a temperature sensor for detecting a temperature of the heater 210 in order to control the temperature and a thermostat as a safety device.

As an example, the flexible endless belt 220 may include a film-shaped base layer (not shown). The base layer may be a metal thin film such as stainless steel, nickel (Ni), or Ni-copper (Cu) or a polymer film having thermal resistance and abrasion resistance, which may withstand a fusing temperature, such as a polyimide film, a polyamide film, or a polyimideamide film. A thickness of the base layer may be set so that the flexible endless belt 220 may have flexibility and elasticity in which the flexible endless belt 220 is flexibly transformed in the fusing nip 201 and, after deviating from the fusing nip 201, may be recovered to an original state. For example, the thickness of the base layer may be about 30 mm to 200 mm. The thickness of the base layer may be, for example, about 50 mm to 100 mm.

A release layer (not shown) may be provided on a surface of the base layer toward the backup member 230 or both surfaces of the base layer. The release layer may be a resin layer with high separability. The release layer may include, for example, one or more among perfluoroalkoxy (PFA), polytetrafluoroethylenes (PTFE), and fluorinated ethylene prophylene (FEP). A thickness of the release layer may be, for example, about 10 mm to 30 mm.

In order to form the fusing nip 201 to be wide and flat, an elastic layer (not shown) may be interposed between the base layer and the release layer. The elastic layer may be formed of a material having thermal resistance, which may withstand a fusing temperature. For example, the elastic layer may be formed of a rubber material such as fluoro rubber or silicon rubber. A thickness of the elastic layer may be, for example, about 10 mm to 50 mm.

As an example, the backup member 230 may be a backup roller that rotates while being pressed to the heater 210 with the flexible endless belt 220 interposed therebetween and drives the flexible endless belt 220. The backup member 230 may include an elastic layer (not shown). As an example, a material of the elastic layer may be a rubber material such as fluoro rubber, silicon rubber, natural rubber, isoprene rubber, butadiene rubber, nitrile rubber, chloroprene rubber, butyl rubber, acryl rubber, hydrin rubber, or urethane rubber or one of various thermoplastic elastomers such as styrene based thermoplastic elastomer, polyolefin based thermoplastic elastomer, polyvinyl chloride based thermoplastic elastomer, polyurethane based thermoplastic elastomer, polyester based thermoplastic elastomer, polyamide based thermoplastic elastomer, polybutadiene based thermoplastic elastomer, trans polyisoprene based thermoplastic elastomer, and chlorinated polyethylene based thermoplastic elastomer. The release layer may include one or more among perfluoroalkoxy (PFA), polytetrafluoroethylenes (PTFE), and fluorinated ethylene prophylene (FEP).

The pressing member 240 may provide a pressing force toward the backup roller 230, for example, to the heater 210. The pressing force may be directly or indirectly provided to the heater 210. As an example, referring to FIG. 2, the pressing member 240 may provide a pressing force to a supporting member 250 by which the heater 210 is supported or a pressing bracket 260 connected to the supporting member 250. A structure in which a pressing force is provided to the heater 210 is not limited to the structure illustrated in FIG. 2.

FIG. 3 is a schematic side view of an example of the heater 210. Referring to FIG. 3, the heater 210 may include a substrate 211, heating elements 212 provided on a surface 211*a* of the substrate 211 that faces the backup member 230, and an electrode (not shown) for supplying a current to the heating elements 212. The heating elements 212 receive electric energy and emit heat. A structure of the heating elements 212 will be described later. An insulating layer 213 covers the heating elements 212 and the electrode. The insulating layer 213 may function as a sliding layer that contacts the flexible endless belt 220. The insulating layer 213 may be, for example, a glass layer.

FIG. 4 is a schematic side view of an example of the heater 210. Referring to FIG. 4, the heater 210 may include the substrate 211, the heating elements 212 provided on a surface 211*b* of the substrate 211 opposite to the surface 211*a* that faces the backup member 230, and an electrode (not shown) for supplying a current to the heating elements 212. The heating elements 212 receive electric energy and emit heat. The structures of the heating elements 212 will be described later. The insulating layer 213 covers the heating elements 212 and the electrode. A sliding layer 214 may be provided on the surface 211*a* of the substrate 211 that faces the backup member 230. The sliding layer 214 may be, for example, a glass layer or a polyimide layer.

In the examples of the heater 210 illustrated in FIGS. 3 and 4, the substrate 211 may be, for example, a ceramic substrate. For example, alumina ($Al_2O_3$) or nitride aluminum (AlN) may be used as a ceramic material. The heating elements 212 may be, for example, metal heating elements such as a silver-palladium (Ag—Pd) alloy. The electrode may be, for example, a silver-platinum (Ag—Pt) electrode or an Ag electrode.

A shape of the heating elements 212 may be determined considering thermal efficiency, fusibility, and prevention of overheating of a region in which the recording medium P does not pass.

The heating elements 212 may include a pair of heating elements symmetrically arranged in a width direction of the substrate 211. The pair of heating elements extend in a length direction of the substrate 211. The width direction of the substrate 211 is a direction in which the recording medium P is fed through the fusing nip 201. The length direction of the substrate 211 is a width direction of the recording medium P and is orthogonal to a direction in which the recording medium P is fed.

The heating elements 212 according to the disclosure may include a plurality of pairs of heating elements that symmetrically make pairs based on the width direction of the substrate 211. The plurality of pairs of heating elements extends in the length direction of the substrate 211. One end of each of the plurality of pairs of heating elements may be connected to a common electrode. The other ends of the plurality of pairs of heating elements may be connected to a plurality of driving electrodes. The plurality of pairs of heating elements may be individually driven or may be driven together. The plurality of pairs of heating elements refers to at least two pairs of heating elements.

In at least a pair of heating elements among the plurality of pairs of heating elements, a heating value per a unit length may vary in a center and at both ends in the length direction. For example, among the plurality of pairs of heating elements, in a pair of outer heating elements positioned in the outermost side, a heating value per a unit length may be higher at both ends than in a center in the length direction of the substrate 211. In a pair of inner heating elements positioned at an inner side of the pair of outer heating elements, a heating value per a unit length may be higher in a center than at both ends in the length direction of the substrate 211. In the above-described configuration, the pair of inner heating elements and the pair of outer heating elements are simultaneously or individually driven so that, when a fusing process is performed on the recording medium P of one of various sizes, it is possible to prevent a region in which the recording medium P does not pass from being overheated.

A length of at least a pair of heating elements among the plurality of pairs of heating elements may be different from lengths of the other pairs of heating elements. For example, the pair of outer heating elements may correspond to the recording medium P of a largest size. A length of the pair of inner heating elements may be smaller than that of the pair of outer heating elements. In the above-described configuration, the pair of inner heating elements and the pair of outer heating elements are individually or simultaneously driven so that, when the fusing process is performed on the recording medium P of one of various sizes, it is possible to prevent the region in which the recording medium P does not pass from being overheated.

An inner distance between the pair of heating elements may affect thermal efficiency and fusibility in the fusing nip 201. A pair of heating elements each having a width of 1 mm are formed on an alumina substrate having a width of 6 mm and, while changing the inner distance between the pair of heating elements to 0 mm, 0.8 mm, 1.6 mm, 2.4 mm, 3.2 mm, and 4 mm, temperatures in a center and at both ends in a width direction of the fusing nip 201 and an average temperature between the temperatures in the center and at the both ends are measured. As a result, as the inner distance is larger, a temperature in the fusing nip 201 is high at the both ends in the width direction and is low in the center. To the contrary, as the inner distance is small, the temperature in the fusing nip 201 is low at the both ends in the width direction and is high in the center. An average temperature in the fusing nip 201 is higher as the inner distance is larger, which means that, as the inner distance is larger, an average quantity of heat that the toner image on the recording medium P receives is larger. That is, as the inner distance is larger, thermal efficiency of the heater 210 is higher.

Based on the width direction, a difference in temperature between the center and the both ends of the fusing nip 201 is larger as the inner distance is smaller. When the difference in temperature between the center and the both ends of the fusing nip 201 is large, during a rise in temperature, thermal stress applied to the heater 210 is concentrated on the center so that possibility of the heater 210 being damaged increases. According to the above, the inner distance may be no less than a thickness of the center of each of the pair of heating elements so that the difference in temperature between the center and the both ends of the fusing nip 201 is reduced and the possibility of the heater 210 being damaged by concentration of thermal stress may be reduced. In addition, when the inner distance is no less than the thickness of the center of each of the pair of heating elements, since an influence of thermal stress is small, the temperature of the heater 210 may rapidly rise.

As the inner distance is larger, fusibility may increase. Fusibility may be measured by, for example, a taping method. In the taping method, optical density of the image printed to the recording medium P is measured, an adhesive tape is attached to the recording medium P and is detached from the recording medium P, optical density of the image recorded in the recording medium P is measured again, and fusibility is determined as a ratio between optical densities before and after taping. A pair of heating elements each having a width of 0.9 mm are formed on an alumina substrate having a width of 5.8 mm and, while changing the inner distance between the pair of heating elements to 0 mm, 2 mm, and 2.8 mm, fusibility is measured. According to the above, in the respective cases, fusibilities are 60.2%, 84.5%, and 88.3%. Therefore, it is noted that fusibility of no less than 80% may be secured by having the inner distance be no less than the thickness of the center of each of the pair of heating elements.

The above-described conditions about the inner distance between a pair of heating elements may be applied to an inner distance between the pair of heating elements positioned at the innermost side among the plurality of pairs of the heating elements as follows. The inner distance between the pair of the innermost heating elements among the plurality of pairs of heating elements may be no less than a value obtained by adding a width of a center in a length direction of a substrate of the pair of the innermost heating elements and a width of a center in a length direction of a substrate of a pair of outer heating elements adjacent to the pair of the innermost heating elements. According to the above-described configuration, as described above, high thermal efficiency and high fusibility may be implemented, the possibility of the heater 210 being damaged may be reduced, and rapid rise in temperature may be performed.

Hereinafter, various examples of the heating elements 212 will be described.

FIG. 5 is a plan view of an example of the heater 210, which illustrates a distribution of heating values. Referring to FIG. 5, the heating elements 212 include a first pair of heating elements 310 (first heating element and second heating element) arranged outside based on the width direction W of the substrate 211 and a second pair of heating elements 320 (third heating element and fourth heating element) positioned at an inner side of the first pair of heating elements 310. An inner distance d between the second pair of heating elements 320 has a value of no less than a value obtained by adding widths of centers in a length direction L of the first pair of heating elements 310 and the second pair of heating elements 320. In other words, the first heating element and the second heating element are provided on the substrate 211 and extend in the length direction of the substrate 211, and are respectively provided at a first side and a second side of the substrate 211 in the width direction of the substrate 211. The second side is opposite of the first side. The third heating element and the fourth heating element are provided on the substrate 211, extend in the length direction, and are provided between the first heating element and the second heating element in the width direction. A distance between the third heating element and the fourth heating element is greater than or equal to a sum of widths of each of the first heating element, second heating element, third heating element, and fourth heating element at a center in the length direction of each of the first heating element, second heating element, third heating element, and fourth heating element. Each the first pair of heating elements 310 and the second pair of heating elements 320 may be symmetrical with each other in the width direction W. A distance between the third heating element and the fourth heating element is greater than or equal to twice a sum of widths of the first heating element and the third heating element at a center in the length direction of each of the first heating element and third heating element. That is, $d \geq 2 \times (d1+d2)$.

An end of each of the first, second, third, and fourth heating elements is connected to a common electrode 400, another end of at least one of the first heating element or the second heating element is connected to a first driving electrode 410, and another end of at least one of the third heating element or the fourth heating element is connected to a second driving electrode 420. For example, one end of each of the first pair of heating elements 310 and the second pair of heating elements 320 is connected to a common electrode 400. The other ends of the first pair of heating elements 310 are connected to a first driving electrode 410. The other ends of the second pair of heating elements 320 are connected to a second driving electrode 420.

The first pair of heating elements 310 and the second pair of heating elements 320 have lengths that may correspond to a largest recording medium P1. The lengths of the first pair of heating elements 310 and the second pair of heating elements 320 may be the same. At least one of the first heating element or the third heating element has a heating value per a unit length that is different in a center of the at least one of the first heating element or the third heating element in the length direction compared to an end of the at least one of the first heating element or the third heating element in the length direction. A heating value per a unit length of the first pair of heating elements 310 is larger at both ends in the length direction L than in the center. A heating value per a unit length of the second pair of heating elements 320 is larger in the center in the length direction L than at the both ends. Distributions of heating values in the length direction L of the first pair of heating elements 310 and the second pair of heating elements 320 are denoted by reference numerals 510 and 520. The distributions of the heating values may be implemented, for example, by having the width of the first pair of heating elements 310 smaller at the both ends in the length direction L than in the center and having the width of the second pair of heating elements 320 smaller in the center in the length direction L than at the both ends. That is, a width of the first heating element at an end of the first heating element is less than a width of the first heating element at the center in the length direction of the first heating element, and the width of the third heating element at the center in the length direction of the third heating element is less than a width of the third heating element at an end of the third heating element. Length of the first heating element and the third heating element are equal. The first pair of heating elements 310 and the second pair of heating elements 320 may be complementary to each other in shape.

For the largest recording medium P1, the first pair of heating elements 310 and the second pair of heating elements 320 may be simultaneously driven so that a heating value in a length direction L of the heater 210 is uniform. For a small recording medium P2, the second pair of heating elements 320 is driven so that a heating value in the center is large by having the heating value of the second pair of heating elements 320 large. The above-described driving may be implemented, for example, by having an amount of supply of a current to the second pair of heating elements 320 larger than an amount of supply of a current to the first pair of heating elements 310. According to the above-described configuration, it is possible to implement high thermal efficiency and to prevent a region in which the recording medium P does not pass from being overheated in a process of fusing the small recording medium P2.

FIG. 6 is a plan view of an example of the heater 210, which illustrates a distribution of heating values. In comparison with the example of the heater 210 illustrated in FIG. 5, a difference between the heater 210 illustrated in FIG. 5 and the heater 210 illustrated in FIG. 6 will be described. At least one of the first heating element or the third heating element has a heating value per unit length that is uniform in the length direction. Widths d1 and d2 of the first pair of heating elements 310 and the second pair of heating elements 320 are uniform in the length direction L. Therefore, heating values per a unit length of the first pair of heating elements 310 and the second pair of heating elements 320 are uniform in the length direction L. A length of the first pair of heating elements 310 is larger than that of the second pair of heating elements 320. That is, a width of each of the first and second heating elements is uniform, a width of each of the third and fourth heating elements is uniform, and a length of each of the first and second heating elements is greater than a length of each of the third and fourth heating elements. The first pair of heating elements 310 may have the length corresponding to the largest recording medium P1. The second pair of heating elements 320 are positioned in the center in the length direction L. Distributions of heating values in the length direction L of the first pair of heating elements 310 and the second pair of heating elements 320 are denoted by the reference numerals 510 and 520 in FIG. 6. An inner distance d between the second pair of heating elements 320 has a value of no less than a value obtained by adding widths of centers in the length direction L of the first pair of heating elements 310 and the second pair of heating elements 320. That is, $d \geq 2 \times (d1+d2)$.

For the largest recording medium P1, the first pair of heating elements may be driven. For the small recording medium P2, the second pair of heating elements may be driven. According to the above-described configuration, it is possible to implement high thermal efficiency and to prevent a region in which the recording medium P does not pass from being overheated in a process of fusing the small recording medium P2.

FIG. 7 is a plan view of an example of the heater 210, which illustrates a distribution of heating values. In comparison with the example of the heater 210 illustrated in FIG. 5, a difference between the heater 210 illustrated in FIG. 5 and the heater 210 illustrated in FIG. 7 will be described. A width d1 of the first pair of heating elements 310 is uniform in the length direction L. Therefore, heating values per a unit length of the first pair of heating elements 310 are uniform in the length direction L. A heating value per a unit length of the second pair of heating elements 320 is larger in a center in the length direction L than at both ends. Distributions of heating values in the length direction L of the first pair of heating elements 310 and the second pair of heating elements 320 are denoted by the reference numerals 510 and 520 in FIG. 7. The distributions of heating values may be implemented, for example, by having a width of the second pair of heating elements 320 smaller in the center in the length direction L than at the both ends. The first pair of heating elements 310 and the second pair of heating elements 320 may have lengths corresponding to the largest recording medium P1. That is, a width of each of the first and second heating elements is uniform, the width of the third heating element at the center in the length direction of the third heating element is less than the width of the third heating element at an end of the third heating element, and the width of the fourth heating element at the center in the length direction of the fourth heating element is less than a width of the fourth heating element at an end of the fourth heating element. A length of the first pair of heating elements 310 may be the same as a length of the second pair of heating elements 320. An inner distance d between the second pair of heating elements 320 has a value of no less than a value obtained by adding widths of centers in the length direction L of the first pair of heating elements 310 and the second pair of heating elements 320. That is, d≥2×(d1+d2).

For the largest recording medium P1, the first pair of heating elements may be driven. For the small recording medium P2, the second pair of heating elements may be driven. According to the above-described configuration, it is possible to implement high thermal efficiency and to prevent a region in which the recording medium P does not pass from being overheated in a process of fusing the small recording medium P2.

FIG. 8 is a plan view of an example of the heater 210, which illustrates a distribution of heating values. Referring to FIG. 8, the heating elements 212 include the first pair of heating elements 310 (first heating element and second heating element) arranged at the outermost side, the second pair of heating elements 320 (third heating element and fourth heating element) positioned at an inner side of the first pair of heating elements 310, and a third pair of heating elements 330 (fifth heating element and sixth heating element) positioned at the innermost side, based on the width direction W of the substrate 211. The fifth heating element and the sixth heating element are provided on the substrate 211, extend in the length direction, and provided between the third heating element and the fourth heating element in the width direction. Each pair of the first pair of heating elements 310, the second pair of heating elements 320, and the third pair of heating elements 330 may be symmetrical with each other in the width direction W. An inner distance d4 between the third pair of heating elements 330 has a value of no less than a value obtained by adding the widths of centers (d3) in the length direction L of the third pair of heating elements 330 and the widths of centers (d2) in the length direction L of the second pair of heating elements 320 adjacent to the third heating elements 330. That is, d4≥2×(d2+d3). That is, a distance between the fifth heating element and the sixth heating element is greater than or equal to a sum of widths of each of the third heating element, fourth heating element, fifth heating element, and sixth heating element at a center in the length direction of each of the third heating element, fourth heating element, fifth heating element, and sixth heating element.

One end of each of the first pair of heating elements 310, the second pair of heating elements 320, and the third pair of heating elements 330 is connected to the common electrode 400. The other ends of the first pair of heating elements 310 are connected to the first driving electrode 410. The other ends of the second pair of heating elements 320 are connected to the second driving electrode 420. The other ends of the third pair of heating elements are connected to a third driving electrode 430.

A length of at least one of the first heating element or the second heating element is different from a length of at least one of the third heating element or the fourth heating element. The first pair of heating elements 310 has a length that may correspond to the largest recording medium P1. A heating value of the first pair of heating elements 310 per a unit length is uniform in the length direction L. That is, a width of the first pair of heating elements 310 is uniform in the length direction L. Lengths of the second pair of heating elements 320 and the third pair of heating elements 330 are smaller than the length of the first pair of heating elements 310. In other words, a width of each of the first and second heating elements is uniform, and lengths of each of the third, fourth, fifth, and sixth heating elements is less than a length of each of the first and second heating elements. As an example, the lengths of the second pair of heating elements 320 and the third pair of heating elements 330 may be the same. The second pair of heating elements 320 and the third pair of heating elements 330 may be positioned in centers in the length direction L.

A heating value per a unit length of a pair of the second pair of heating elements 320 and the third pair of heating elements 330 is larger at both ends in the length direction L than in a center. A heating value per a unit length of the other pair of the second pair of heating elements 320 and the third pair of heating elements 330 is larger in a center in the length direction L than at both ends. The above-described distribution of heating values may be implemented, for example, by having a width of a pair of the second pair of heating elements 320 and the third pair of heating elements 330 smaller at the both ends in the length direction L than in the center and by having a width of the other pair of the second pair of heating elements 320 and the third pair of heating elements 330 smaller in the center in the length direction L than at the both ends. In other words, the width of the third heating element at the center in the length direction of the third heating element is less than a width of the third heating element at an end of the third heating element and the width of the fifth heating element at the center in the length direction of the fifth heating element is greater than a width of the fifth heating element at an end of the fifth heating element, or the width of the third heating element at the center in the length direction of the third heating element is greater than the width of the third heating element at the end of the third heating element and the width of the fifth heating element at the center in the length direction of the fifth heating element is less than a width of the fifth heating element at the end of the fifth heating element. According to the example, a heating value of the second pair of heating elements 320 per a unit length is larger at both ends in the length direction L than in a center. A heating value of the third pair of heating elements 330 per a unit length is larger in a center in the length direction L than at both ends. For example, a width of the second pair of heating elements 320 is smaller at both ends in the length direction L than in a center and a width of the third pair of heating elements 330 is smaller in a center in the length direction L than at both ends. The second pair of heating elements 320 and the third pair of heating elements 330 may be complementary to each other in shapes. Distributions of heating values in the length direction L of the first pair of heating elements 310, the second pair of heating elements 320, and the third pair of heating elements 330 are denoted by reference numerals 510, 520, and 530, respectively in FIG. 8.

For the largest recording medium P1, the first pair of heating elements 310 may be driven so that a heating value of the heater 210 in the length direction L is uniform. For the small recording medium P2, the second pair of heating elements 320 and the third pair of heating elements 330 may be simultaneously driven. For a smaller recording medium P3, the third pair of heating elements 330 may be driven. According to the above-described configuration, it is possible to implement high thermal efficiency and to prevent a region in which the small recording mediums P2 and P3 do not pass from being overheated in a process of fusing the small recording mediums P2 and P3.

FIG. 9 is a plan view of an example of the heater 210, which illustrates a distribution of heating values. FIG. 9 is a modification of the example of the heater 210 illustrated in FIG. 8, in which a heating value of the second pair of heating elements 320 per a unit length is larger in a center in the length direction L than at both ends and a heating value of the third pair of heating elements 330 per a unit length is larger at both ends in the length direction L than in a center.

For example, a width of the second pair of heating elements 320 is smaller in the center in the length direction L than at the both ends and a width of the third pair of heating elements 330 is smaller at the both ends in the length direction L than in the center. The second pair of heating elements 320 and the third pair of heating elements 330 may be complementary to each other in shapes. Distributions of heating values in the length direction L of the first pair of heating elements 310, the second pair of heating elements 320, and the third pair of heating elements 330 are denoted by the reference numerals 510, 520, and 530, respectively in FIG. 9. An inner distance d4 between the third pair of heating elements 330 has a value of no less than a value obtained by adding widths of centers (d3) in the length direction L of the third pair of heating elements 330 and the widths of centers (d2) in the length direction L of the second pair of heating elements 320 adjacent to the third heating elements 330. That is, $d4 \geq 2 \times (d2+d3)$.

For the largest recording medium P1, the first pair of heating elements 310 may be driven so that a heating value of the heater 210 in the length direction L is uniform. For the small recording medium P2, the second pair of heating elements 320 and the third pair of heating elements 330 may be simultaneously driven. For a smaller recording medium P3, the second pair of heating elements 320 may be driven. According to the above-described configuration, it is possible to implement high thermal efficiency and to prevent a region in which the small recording mediums P2 and P3 do not pass from being overheated in a process of fusing the small recording mediums P2 and P3.

FIG. 10 is a plan view of an example of the heater 210, which illustrates a distribution of heating values. FIG. 10 is a modification of the example of the heater 210 illustrated in FIG. 8, in which heating values of the first pair of heating elements 310, the second pair of heating elements 320, and the third pair of heating elements 330 per a unit length are uniform in the length direction L. That is, widths of the first pair of heating elements 310, the second pair of heating elements 320, and the third pair of heating elements 330 are uniform in the length direction L. The first pair of heating elements 310 has a length that may correspond to the largest recording medium P1. A length of the second pair of heating elements 320 is smaller than that of the first pair of heating elements 310. A length of the third pair of heating elements 330 is smaller than that of the second pair of heating elements 320. For example, the second pair of heating elements 320 and the third pair of heating elements 330 may have lengths respectively corresponding to the small recording mediums P2 and P3. In other words, widths of the first, second, third, fourth, fifth, and sixth heating elements are uniform, a length of each of the third and fourth heating elements is less than a length of each of the first and second heating elements, and a length of each of the fifth and sixth heating elements is less than the length of each of the third and fourth heating elements. The second pair of heating elements 320 and the third pair of heating elements 330 may be positioned in a center in the length direction L. Distributions of heating values in the length direction L of the first pair of heating elements 310, the second pair of heating elements 320, and the third pair of heating elements 330 are denoted by the reference numerals 510, 520, and 530, respectively in FIG. 10. An inner distance d4 between the third pair of heating elements 330 has a value of no less than a value obtained by adding the widths of centers (d3) in the length direction L of the third pair of heating elements 330 and the widths of centers (d2) in the length direction L of the second pair of heating elements 320 adjacent to the third heating elements 330. That is, $d4 \geq 2 \times (d2+d3)$.

For the largest recording medium P1, the first pair of heating elements 310 may be driven. For the small recording medium P2, the second pair of heating elements 320 may be driven. For a smaller recording medium P3, the third pair of heating elements 330 may be driven. According to the above-described configuration, it is possible to implement high thermal efficiency and to prevent a region in which the small recording mediums P2 and P3 do not pass from being overheated in a process of fusing the small recording mediums P2 and P3.

According to the above-described examples, a driving electrode is connected to the other ends of a pair of heating elements. However, a pair of driving electrodes corresponding to the pair of heating elements may be used. According to the above-described configuration, since the pair of heating elements may be simultaneously driven or one heating element of the pair of heating elements may be driven, it is possible to precisely control a temperature and to improve thermal efficiency.

According to the above-described examples, due to a shape in which a width slowly changes in the length direction L, a heating element in which heating values vary in a center and at both ends is implemented. The heating element in which the heating values vary in the center and at the both ends may be implemented by another shape. For example, the heating element in which the heating values vary in the center and at the both ends may be also implemented by a stepped shape in which the center has a first width and the both ends have a second width. In addition, a width of the heating element may change by stages from the center to the both ends.

A pressing force provided by the pressing member 240 to the heater 210 and the backup member 230 may vary. For example, while fusing is performed, sufficient pressing force is provided to the heater 210 and the backup member 230 in order to improve fusibility and, while fusing is not performed, in order to reduce stress applied to the flexible endless belt 220 and the backup member 230, a pressing force may be reduced or removed. An envelope may be used as the recording medium P. When the pressing force is strong, the envelope may be wrinkled while the envelope passes the fusing nip 201. The occurrence of wrinkling may be resolved by reducing pressing force. A pressing force at this time may be smaller than a pressing force while fusing is performed and may be larger than a pressing force while fusing is not performed.

FIGS. 11A, 11B, and 11C are schematic block diagrams of an example of the fuser 200. Referring to FIGS. 11A, 11B, and 11C, a pressing force variable member 270 for varying pressing force is adopted. For example, the pressing force variable member 270 may include a pressing lever 271 rotatable about a hinge 271-1 and including a cam contacting portion 271-2, and a rotating cam 272 that faces the cam contacting portion 271-2. The pressing member 240 presses the pressing lever 271. The pressing member 240 may be, for example, a compressive coil spring. The pressing lever 271 may press, for example, the pressing bracket 260. The rotating cam 272 may include a first portion 272-1, a second portion 272-2, and a third portion 272-3 having different radiuses from a rotation center 272-4. The radius from the rotation center 272-4 is the smallest in the first portion 272-1 and increases in the order of the second portion 272-2 and the third portion 272-3. When the rotating cam 272 rotates, the first portion 272-1, the second portion 272-2, and the third portion 272-3 sequentially face the cam contacting portion 271-2. The rotating cam 272 may be rotated by a motor that is not shown.

As illustrated in FIG. 11A, during fusing, the first portion 272-1 faces the cam contacting portion 271-2. The first portion 272-1 may be separate from the cam contacting portion 271-2. The largest pressing force is applied to the heater 210 and the backup member 230.

When the envelope is used as the recording medium P, as illustrated in FIG. 11B, the second portion 272-2 contacts the cam contacting portion 271-2. Then, the pressing lever 271 rotates about the hinge 271-1, and pressing force is reduced. Therefore, since a small pressing force is applied, it is possible to prevent the envelope from being wrinkled in a fusing process.

When fusing is not performed, as illustrated in FIG. 11C, the third portion 272-3 contacts the cam contacting portion 271-2. Then, the pressing lever 271 further rotates about the hinge 271-1 so that the pressing force may be reduced or removed.

A structure of the pressing force variable member 270 is not limited to the examples illustrated in FIGS. 11A, 11B, and 11C and various modifications are available.

While examples have been described with reference to the drawings, it will be understood that various changes in form and details may be made therein without departing from the spirit and scope as defined by the following claims.

The invention claimed is:

1. A heater for a fuser, the heater comprising:

a substrate;

a first heating element and a second heating element, each provided on the substrate and extending in a length direction of the substrate, and respectively provided at a first side and a second side of the substrate in a width direction of the substrate, the second side being opposite of the first side; and a third heating element and a fourth heating element, each provided on the substrate, extending in the length direction, and provided between the first heating element and the second heating element in the width direction, and a distance between the third heating element and the fourth heating element is greater than or equal to a sum of widths of each of the first heating element, second heating element, third heating element, and fourth heating element at a center in the length direction of each of the first heating element, second heating element, third heating element, and fourth heating element, wherein a width of each of the first and second heating elements is uniform, a width of each of the third and fourth heating elements is uniform, and a length of each of the first and second heating elements is greater than a length of each of the third and fourth heating elements.

2. The heater for a fuser of claim 1, further comprising:

a fifth heating element and a sixth heating element provided on the substrate, each extending in the length direction and provided between the third heating element and the fourth heating element in the width direction, and a distance between the fifth heating element and the sixth heating element is greater than or equal to a sum of widths of each of the third heating element, fourth heating element, fifth heating element, and sixth heating element at a center in the length direction of each of the third heating element, fourth heating element, fifth heating element, and sixth heating element.

3. The heater for a fuser of claim 2, wherein a width of the fifth and sixth heating elements is uniform, and a length of each of the fifth and sixth heating elements is less than the length of each of the third and fourth heating elements.

4. A heater for a fuser, comprising:

a substrate;

a first heating element and a second heating element, each provided on the substrate and extending in a length direction of the substrate, and respectively provided at a first side and a second side of the substrate in a width direction of the substrate, the second side being opposite of the first side; and a third heating element and a fourth heating element, each provided on the substrate, extending in the length direction, and provided between the first heating element and the second heating element in the width direction, and a distance between the third heating element and the fourth heating element is greater than or equal to a sum of widths of each of the first heating element, second heating element, third heating element, and fourth heating element at a center in the length direction of each of the first heating element, second heating element, third heating element, and fourth heating element, wherein a width of the first heating element at an end of the first heating element is less than the width of the first heating element at the center in the length direction of the first heating element, the width of the third heating element at the center in the length direction of the third heating element is less than a width of the third heating element at an end of the third heating element, and lengths of the first heating element and the third heating element are equal.

5. The heater for a fuser of claim 4, further comprising:

a fifth heating element and a sixth heating element provided on the substrate, each extending in the length direction and provided between the third heating element and the fourth heating element in the width direction, and a distance between the fifth heating element and the sixth heating element is greater than or equal to a sum of widths of each of the third heating element, fourth heating element, fifth heating element, and sixth heating element at a center in the length direction of each of the third heating element, fourth heating element, fifth heating element, and sixth heating element.

6. The heater for a fuser of claim 5, wherein the width of the fifth heating element at the center in the length direction of the fifth heating element is less than a width of the fifth heating element at an end of the fifth heating element.

7. A heater for a fuser, comprising:

a substrate;

a first heating element and a second heating element, each provided on the substrate and extending in a length direction of the substrate, and respectively provided at a first side and a second side of the substrate in a width direction of the substrate, the second side being opposite of the first side; and a third heating element and a fourth heating element, each provided on the substrate, extending in the length direction, and provided between the first heating element and the second heating element in the width direction, and a distance between the third heating element and the fourth heating element is greater than or equal to a sum of widths of each of the first heating element, second heating element, third heating element, and fourth heating element at a center in the length direction of each of the first heating element, second heating element, third heating element, and fourth heating element, wherein a width of each of the first and second heating elements is uniform, the width of the third heating element at the center in the length direction of the third heating element is less than a width of the third heating element at an end of the third heating element, and the width of the fourth heating element at the center in the length direction of the fourth heating element is less than a width of the fourth heating element at an end of the fourth heating element.

8. The heater for a fuser of claim 7, further comprising:

a fifth heating element and a sixth heating element provided on the substrate, each extending in the length direction and provided between the third heating element and the fourth heating element in the width direction, and a distance between the fifth heating element and the sixth heating element is greater than or equal to a sum of widths of each of the third heating element, fourth heating element, fifth heating element, and sixth heating element at a center in the length direction of each of the third heating element, fourth heating element, fifth heating element, and sixth heating element.

9. The heater for a fuser of claim 8, wherein the width of the fifth heating element at the center in the length direction of the fifth heating element is greater than a width of the fifth heating element at an end of the fifth heating element.

10. A heater for a fuser, the heater comprising:

a substrate;

a first pair of heating elements including a first heating element and a second heating element provided on the substrate, each extending in a length direction of the substrate, and respectively provided at a first side and a second side of the substrate in a width direction of the substrate, the second side being opposite of the first side;

a second pair of heating elements including a third heating element and a fourth heating element provided on the substrate, each extending in the length direction and provided between the first heating element and the second heating element in the width direction, and a distance between the third heating element and the fourth heating element is greater than or equal to twice a sum of widths of the first heating element and the third heating element at a center in the length direction of each of the first heating element and third heating element;

a common electrode connected to an end of each of the first, second, third, and fourth heating elements;

a first driving electrode connected to another end of at least one of the first heating element or the second heating element; and a second driving electrode connected to another end of at least one of the third heating element or the fourth heating element.

11. The heater for a fuser of claim 10, wherein at least one of the first heating element or the third heating element has a heating value per a unit length that is different in a center of the at least one of the first heating element or the third heating element in the length direction compared to an end of the at least one of the first heating element or the third heating element in the length direction.

12. The heater for a fuser of claim 10, wherein a length of at least one of the first heating element or the second heating element is different from a length of at least one of the third heating element or the fourth heating element.

13. The heater for a fuser of claim 10, wherein at least one of the first heating element or the third heating element has a heating value per unit length that is uniform in the length direction.

14. A fuser, comprising:

a flexible endless belt;

a heater provided inside the flexible endless belt to heat the flexible endless belt, the heater including:

a substrate, a first heating element and a second heating element, each provided on the substrate and extending in a length direction of the substrate, and respectively provided at a first side and a second side of the substrate in a width direction of the substrate, the second side being opposite of the first side, and a third heating element and a fourth heating element, each provided on the substrate, extending in the length direction, and provided between the first heating element and the second heating element in the width direction, and a distance between the third heating element and the fourth heating element is greater than or equal to a sum of widths of each of the first heating element, second heating element, third heating element, and fourth heating element at a center in the length direction of each of the first heating element, second heating element, third heating element, and fourth heating element, wherein a width of the first heating element at an end of the first heating element is less than the width of the first heating element at the center in the length direction of the first heating element, the width of the third heating element at the center in the length direction of the third heating element is less than a width of the third heating element at an end of the third heating element, and lengths of the first heating element and the third heating element are equal, or a width of each of the first and second heating elements is uniform, a width of each of the third and fourth heating elements is uniform, and a length of each of the first and second heating elements is greater than a length of each of the third and fourth heating elements, or a width of each of the first and second heating elements is uniform, the width of the third heating element at the center in the length direction of the third heating element is less than a width of the third heating element at an end of the third heating element, and the width of the fourth heating element at the center in the length direction of the fourth heating element is less than a width of the fourth heating element at an end of the fourth heating element;

a backup member provided outside the flexible endless belt to face the heater; and a pressing member to provide a pressing force to at least one of the heater or the backup member.

15. The fuser of claim 14, further comprising a pressing force variable member to vary the pressing force.

16. The fuser of claim 14, wherein the heater further includes:

a fifth heating element and a sixth heating element provided on the substrate, each extending in the length direction and provided between the third heating element and the fourth heating element in the width direction, and a distance between the fifth heating element and the sixth heating element is greater than or equal to a sum of widths of each of the third heating element, fourth heating element, fifth heating element, and sixth heating element at a center in the length direction of each of the third heating element, fourth heating element, fifth heating element, and sixth heating element.

* * * * *